US005327975A

United States Patent [19]

Land

[11] Patent Number: 5,327,975

[45] Date of Patent: Jul. 12, 1994

[54] TUBING ANCHOR CATCHER WITH ROTATING MANDREL

[75] Inventor: John L. Land, Hobbs, N. Mex.

[73] Assignee: Rotating Production Systems, Inc., Hobbs, N. Mex.

[21] Appl. No.: 889,569

[22] Filed: May 28, 1992

Related U.S. Application Data

[63] Continuation-in-part of Ser. No. 682,499, Apr. 8, 1991, Pat. No. 5,139,090.

[51] Int. Cl.[5] ..... E21B 17/046

[52] U.S. Cl. ..... 166/369; 166/68; 166/73; 166/78; 166/117.7; 166/216; 166/240; 166/242; 166/382

[58] Field of Search ..... 166/68, 68.5, 69, 73, 166/78, 117.7, 210, 240, 242, 369, 378, 379, 380, 382, 381, 216

[56] References Cited

U.S. PATENT DOCUMENTS

| | | | |
|---|---|---|---|
| 1,560,984 | 11/1925 | Gorbutt . | |
| 1,650,102 | 11/1927 | Tschappat . | |
| 1,965,907 | 7/1934 | Pierce | 166/14 |
| 2,178,700 | 11/1939 | Penick et al. | 166/14 |
| 2,294,061 | 8/1942 | Williamson | 166/78 |
| 2,471,198 | 5/1949 | Cormany | 166/78 |
| 2,595,434 | 5/1952 | Williams | 166/78 |
| 2,630,181 | 3/1953 | Solum | 166/14 |
| 2,693,238 | 11/1954 | Baker | 166/78 |
| 2,788,074 | 4/1957 | Brown | 166/78 |
| 2,876,844 | 3/1959 | Warner | 166/208 |
| 3,075,584 | 1/1963 | Brown | 166/210 X |
| 3,100,538 | 8/1963 | Sanders | 166/117.7 |
| 3,171,491 | 3/1965 | States | 166/208 |
| 3,643,737 | 2/1972 | Current et al. | 166/139 X |
| 4,010,804 | 3/1977 | Garcia | 166/208 X |
| 4,278,278 | 7/1981 | Chambless et al. | 166/240 X |
| 4,601,343 | 7/1986 | Lindsey, Jr. et al. | 166/242 X |
| 4,688,642 | 8/1987 | Baker | 166/382 |
| 4,926,938 | 5/1990 | Lindsey, Jr. | 166/208 |

*Primary Examiner*—Hoang C. Dang
*Attorney, Agent, or Firm*—Marcus L. Bates

[57] ABSTRACT

A cased wellbore extends downhole to a pay zone which is produced by a rod actuated downhole pump that lifts fluid from the bottom of the wellbore up through a tubing string to a wellhead. The pump is seated in a pump cavity, and the tubing string is tensioned and is rotated. The upper end of the tubing string is attached to a fluid conveying swivel and a tubing rotator. A combination tubing anchor having a fluid conveying rotatable mandrel is attached adjacent to and forms part of the lower end of the tubing string by which the lower end of the tubing string is rotatably and releasably affixed to the casing in proximity to the lower end of the wellbore. A plurality of radially active slips are actuated in response to manipulation of the tubing string to extend the slips into engagement with the casing wall and to retract the slips in order to remove the tubing string from the borehole.

18 Claims, 3 Drawing Sheets

36
64
45
44
49
46
58
34
49'
44'
45'
65
70
166
37
40

36
35
44
58
46
44'
70
166
37
40
36
64
162
150
35
152
153
154
160
161
165'
37

37
168
37
40
45
44
48
49
73
46
58
44'
49'
45'
165
170
102
98
97
98'
100
99
166
68
101
68'

TUBING ANCHOR CATCHER WITH ROTATING MANDREL

RELATED PATENT APPLICATIONS

This patent application is a continuation-in-part of my co-pending patent application Ser. No. 07/682,499 filed Apr. 8, 1991, now U.S. Pat. No. 5,139,090, issued Aug. 18, 1992.

BACKGROUND OF THE INVENTION

In my co-pending patent application, Ser. No. 07/682,499 filed Apr. 8, 1991, now the U.S. Pat. No. 5,139,090 of which this application is a continuation-in-part, it is pointed out that rotating the production tubing string respective to the sucker rod and casing string while concurrently placing the production tubing string in tension reduces the severity of wear of a curved tubing string by reducing the contact area between the tubing string and rod string. This redistribution of wear between the sucker rod string and the tubing string is very desirable for it reduces the maintenance cost of the well, and additionally reduces the cyclic working (tension changes) of the production string and thereby overcomes many problems associated with crooked wellbores. Moreover, such an arrangement provides the unexpected benefit of enhancing the protection of the sucker rod and production tubing afforded by corrosion inhibitors which is realized because the rod and tubing rubbing surfaces are continually moved away from the contact area therebetween, thereby progressively treating the entire surface of the rod and tubing string each rotation of the tubing string.

The present invention comprehends improvements over the co-pending patent application by the provision of a new anchor device having a mandrel rotatably extending therethrough and connected to the rotating production tubing string by which the production tubing string is placed in tension while being rotated from the surface, thus greatly simplifying the production equipment required for producing the well.

SUMMARY OF THE INVENTION

A cased wellbore extends downhole from a wellhead to a pay zone which is produced by a rod actuated downhole pump that lifts fluid from the bottom of the wellbore up through a tubing string to the wellhead. A tubing rotator has a tubing hanger that is rotatably attached adjacent the upper end of the production tubing string and rotatably supports the tubing string from the wellhead while placing the upper end of the tubing string in tension. A fluid conveying swivel means is attached near the rotator to allow produced fluid to flow away from the upper end of the tubing string.

A combination tubing anchor catcher with fluid conveying rotatable mandrel is attached to and forms part of the tubing string. The tubing anchor affixes the tubing string to the casing at a location downhole in the wellbore for holding a lower end of the tubing string in tension.

One embodiment of the invention discloses a tubing anchor having a rotatable mandrel extending longitudinally therethrough and forming a part of the lower end of the tubing string; and, further includes a journal means by which the mandrel rotates respective to the anchor device to provide the means by which the lower end of the tubing string is rotatably held tensioned respective to the tubing anchor, sucker rod string, and casing string while conveying fluid from the downhole pump, up through the rotating tensioned production tubing string, and to the swivel at the top of the wellbore.

More specifically, the anchor device has an outer barrel concentrically arranged within the casing and extending about the rotatable mandrel, and the rotating mandrel is hollow and extends about the sucker rod string. A locking device selectively locks and unlocks the mandrel to the barrel so that retraction and extension of the tubing anchor slips is achieved upon manipulation of the tubing string which results in the tubing anchor slips being anchored and released respective to the casing wall. The tubing anchor mandrel forms an axial passageway through which the sucker rod string and produced fluid passes when the production pump is located therebelow. The tubing string can be placed in tension between a rotator (at the well head) and the downhole anchor device, and the tensioned tubing string rotated respective to the rod string and casing.

A primary object of the present invention is the provision of a tubing anchor device having a fluid conveying rotatable mandrel and includes slips by which the lower end of a tubing string is rotatably and releasably affixed to the casing in proximity to the lower end of a wellbore.

Another object of the invention is to provide and disclose a downhole tubing anchor device for a rod actuated downhole pump that includes a journaled mandrel and slips by which a fluid conveying tensioned tubing string can rotate respective to the anchor slips, rod string, and well casing.

A still further object of this invention is to provide a downhole tubing anchor device with mandrel to which there is rotatably attached a production tubing string of a wellbore. The tubing string is placed under tension and rotated respective to the anchor device. Means are provided by which the mandrel is moved between alternate positions of operation to anchor and to release the anchor device respective to the casing wall.

Another and still further object of this invention is the provision of method and apparatus for reducing wear between a rod string and a tubing string used in producing a crooked borehole by connecting the tubing string to a rotating mandrel of an anchor device and rotating the tubing string respective to the sucker rod and casing string thereof while concurrently placing the tubing string in tension and thereby reducing the severity of wear of the curved string by reducing the contact area between the tubing and rod string and concurrently distributing the wear between the sucker rod string and the tubing string.

An additional object of the present invention is the provision of a fluid conveying rotatable mandrel for an anchor device having slips that can be set from the surface of the ground in response to movement of the tubing string.

An additional object of the present invention is the provision of a rotatable production tubing string suspended from a wellhead and placed in tension by releasably anchoring the lower marginal end of the production tubing string to the interior of a well casing, and additionally providing a downhole journal means in the anchor device, and also provide a tubing rotator apparatus at the surface of the ground; and the further provision of means by which the downhole journal means can be locked and unlocked by manipulating the upper end of the tubing string from the surface of the ground so that the tubing string and other production equipment can be removed from the wellbore.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein for use with the disclosed method.

DETAILED DESCRIPTION OF THE PREFERRED EMBODIMENT

Figure 1:
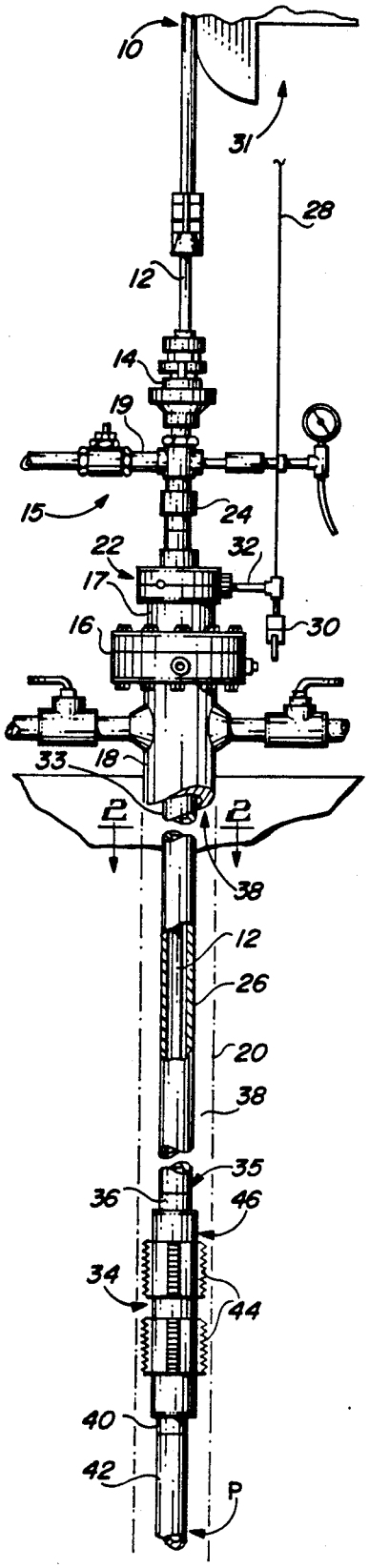
FIG. 1 is a broken, side elevational, part cross-sectional view of an oil well production unit having apparatus made in accordance with the present invention included therein, with some parts thereof being broken away therefrom, and some of the remaining parts being shown in cross-section.

FIG. 1 of the drawings disclose a production unit by which a well is produced. A pumpjack unit 10 having a horse head and bridle for reciprocating a polish rod 12' is shown. The polish rod sealingly extends through a stuffing box 14 located on the Christmas tree 15 and into a wellhead 16 attached to the upper end of the usual surface casing 18. Numeral 20 indicates the well casing string that is located therewithin and extends downhole to form a cased borehole. Produced fluid flows away from the wellbore through lateral pipe 19.

A tubing rotator 22, the details of which are more fully disclosed later on herein and in the U.S. Pat. No. 5,139,090, is fastened to the wellhead by adaptor 17 and is connected to a fluid conveying swivel means 24 at a location interposed between stuffing box 14 and tubing rotator 22 so that the tubing string 26 can convey fluid therethrough and rotate respective to the wellhead 16, casing 20, and stuffing box 14. Actuator pull line 28 is attached to the free end of a ratchet arm 30 and is successively pulled by each oscillation of the rocking beam at 31 (only partially shown) and thereby successively ratchets and rotates a shaft 32 by oscillating the ratchet arm 30 in response to each oscillation of the horse-head and walking beam of the pumpjack unit 10. The tubing rotator 22 is connected to rotate a hanger mandrel 33 by which the upper end of the tubing string 26 is supported from the wellhead and can be placed in tension while it is concurrently rotated by the hanger mandrel 33. The details of the hanger mandrel 33 and the tubing rotator 22 is more fully set forth in the U.S. Pat. No. 5,139,090.

A downhole anchor device 34, sometime referred to as an anchor tubing catcher, and made in accordance with the present invention, has a fluid conveying rotatable anchor mandrel 35 (see FIGS. 3 and 4) extending from opposed ends thereof. Upper end 36 of the anchor mandrel 35 is connected to production tubing string 26 and forms part of the tubing string. The tubing string 26 forms casing annulus 38 respective to the casing 20. A lower end 40 of the mandrel 35 is affixed to the upper end of the lower part 42 of the tubing string. The anchor device 34 includes slip assembly 44 having individual slips 45 mounted for radial movement respective to a barrel 46 and radially extend from the central longitudinal axis of the anchor device 34 for engagement with the interior wall surface of casing 20. The lower end 40 of the anchor mandrel 35 of the anchor device 34 is attached to an upper end of a lower length 42 of production tubing string 26 within which a downhole pump P (not shown) resides. Other downhole tools, such as gas anchors, seating nipples, and the like, may be included below the anchor device 34, as may be desired. These other downhole tools are known to those skilled in the art.

Figure 2:
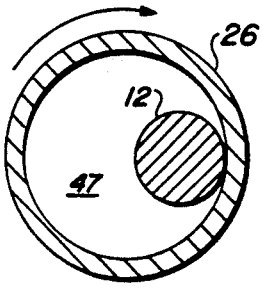
FIG. 2 is an enlarged, cross-sectional view taken along line 2—2 of FIG. 1.

FIG. 2 illustrates the rod string 12 extending through the rotatable, tensioned production tubing 26 and forming an irregular annulus 47 therewith. Therefore the well of the FIG. 2 is a crooked borehole. The mandrel 35 of FIGS. 1 and 3 has an interior diameter that is approximately equal to the inside diameter of the tubing string so that anything that can be lowered down through the production tubing string can also be extended through the anchor device of the present invention. This avoids costly fishing jobs.

Figure 3:
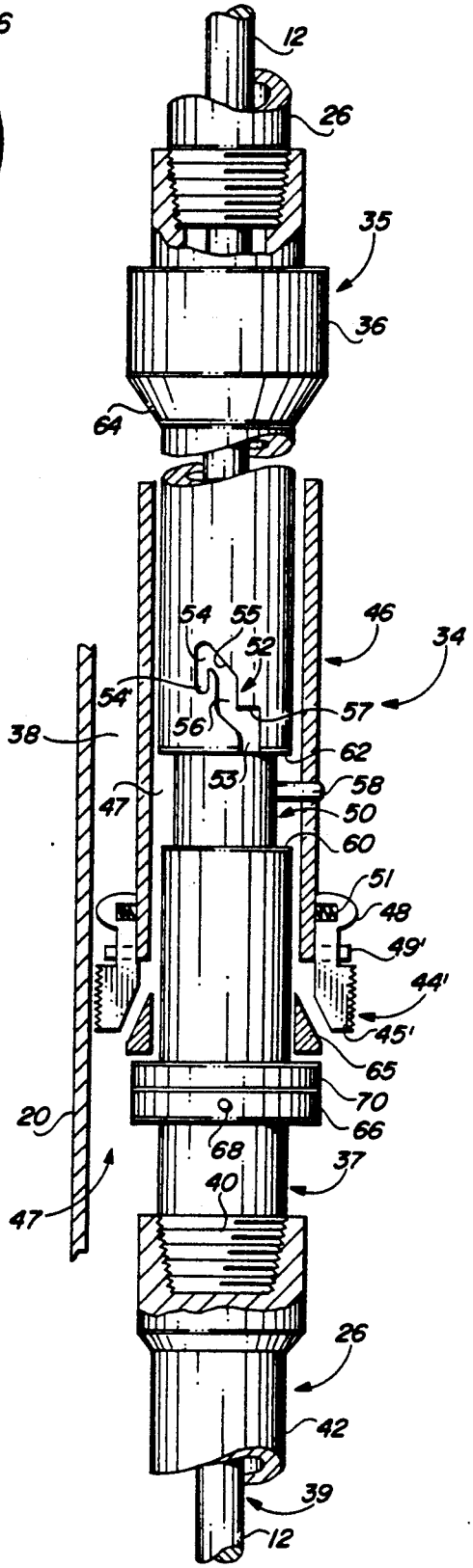
FIG. 3 is an enlarged, broken, part cross-sectional, part dissembled, diagrammatical representation of part of the apparatus disclosed in FIG. 1.

FIG. 3, together with other figures of the drawings, broadly illustrates, in a diagrammatical manner, the relationship between the various parts of the anchor device and particularly discloses a locking device having a J-pin that can be captured within a J-slot, the details of which will be more fully discussed later on in this disclosure.

Figures 4, 5, 6:
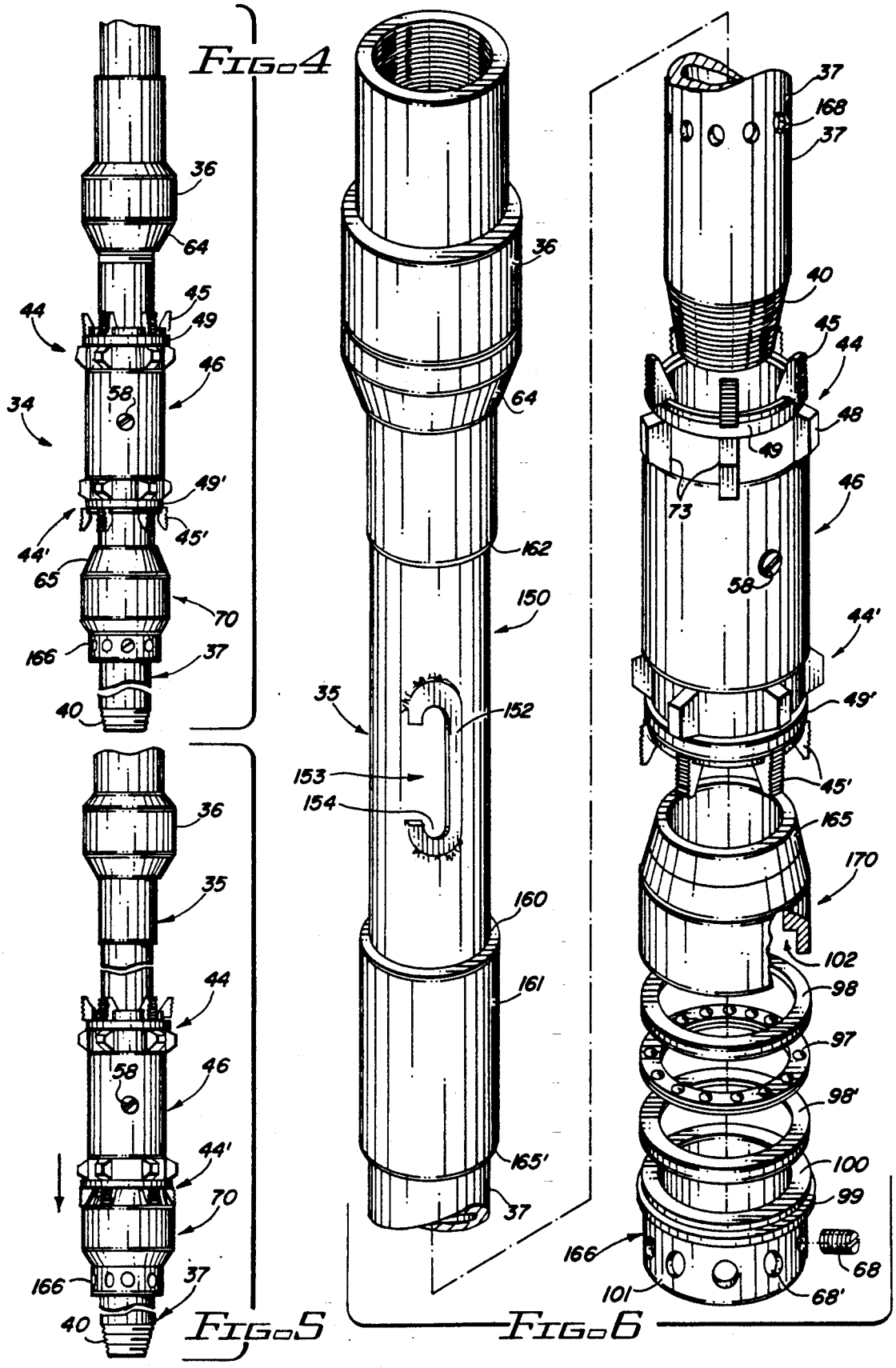
FIG. 4 is an enlarged, broken, side elevational view of an alternate embodiment of part of the apparatus disclosed in FIG. 3.
FIG. 5 illustrates the apparatus disclosed in FIG. 4 in an alternate position of operation.
FIG. 6 is an exploded view of the apparatus of FIG. 5.
Figure 7:
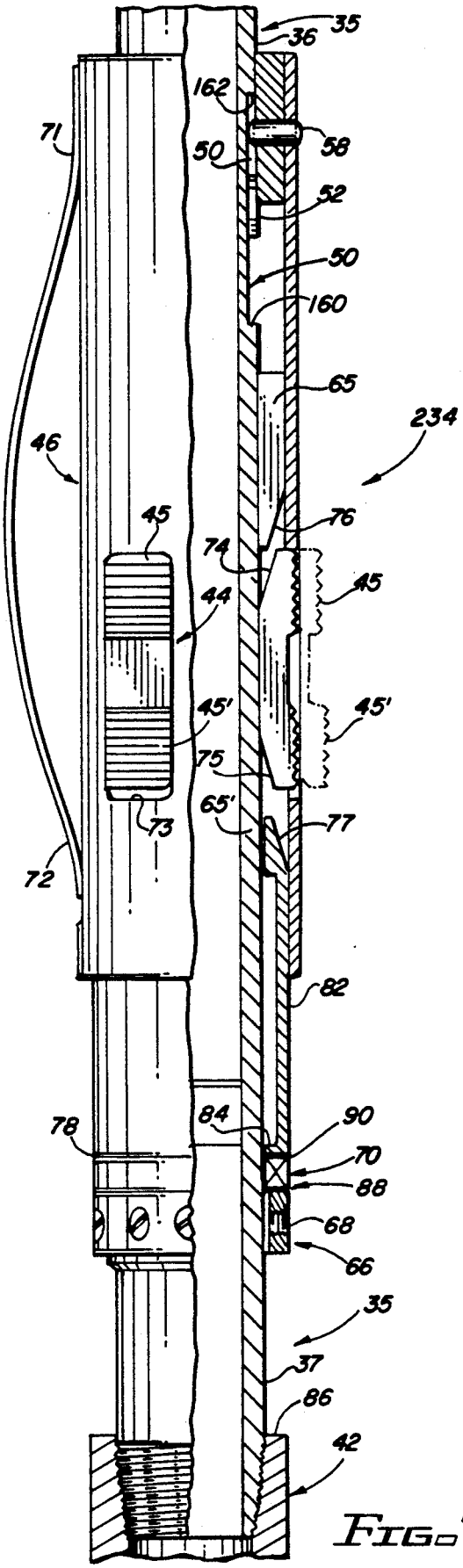
FIG. 7 is a broken, side elevational, longitudinal, part cross-sectional view of apparatus made in accordance with another embodiment of the present invention.

The slip assembly 44 of FIGS. 3, 6, and 7 include radially active, circumferentially spaced slips 45 mounted therewith; and, each having an enlargement 48 biased by spring 51 radially outward into engagement with the casing wall. The enlargement 48 acts as a drag device for reasons that will be more fully appreciated later on as this disclosure is more fully digested. A medial body portion of each slip 45 is pivotally received by a boss 49 formed at opposed ends of the anchor barrel 46. A medial part of mandrel 35 is received within the barrel, and the medial part is provided with a circumferentially extending groove 50 that is in communication with a J-slot 52. The J-slot 52 upwardly extends from groove 50.

As seen in FIG. 3, the J-slot 52 commences at vertical entrance 53 and terminates at vertical blind end part 54. Vertical part 56 is parallel to parts 53 and 54, with the upper ends of parts 54 and 56 being interconnected by sloped part 55. Shoulder 57 of the J-slot serves to catch the J-pin 58 should the tubing string somehow inadvertently release and drop downhole while rotating. Groove 50 circumferentially extends 360 degrees about the mandrel and terminates at spaced apart shoulders 60 and 62, except for the J-slot 52, as noted.

In FIG. 3, bearing 70 has an inner part that is slidably received about the mandrel 35, and further includes an upper surface that abuts lower face of movable annular cone 65. Annular flange 66 is attached to the mandrel 35 by a plurality of shear pins 68 which are radially arranged and fix the flange 66 to the mandrel. The shear pins 68 are designed to shear and fail at a value in excess of the anticipated desired tension forces applied to the tubing string by means of the anchor device 34 located at the lower end of the tubing string and the tubing hanger located within the rotator 22 at the upper end of the tubing string (see FIG. 1).

When the J-pin 58 is located at the upper extremity of J-slot part 54, the anchor device is in the "running in" position. In this position, clockwise rotation of the tubing string while lifting the tubing string will unlatch the J-pin 58 from the J-slot 52. When the mandrel 35 is lifted up the borehole, the J-pin 58 moves from 54 to position 54', whereupon the mandrel is locked to the barrel 46, and when the mandrel is rotated, the barrel rotates therewith. This action is advantageously used to set the slip assembly 44 in a number of known manners in addition to the details set forth herein.

FIG. 3 shows that the mandrel has been set down and turned clockwise before being lifted in order to release the J-pin from the J-pin slot and thereby positioned the pin within the wide groove 50, as shown. The J-pin 58 is moved from the running in position 54 into the illustrated position of FIG. 3, which is the rotatable operative position, by lifting the mandrel while it is rotated clockwise by rotating the tubing string. The pin 58 will travel from 54, down parts 55, 56, through entrance 53 and into groove 50 where the J-pin is free of the J-slot and thereby allows the mandrel to be freely rotated respective to the barrel until it is again manipulated back into the part 54' of the J-slot 52. Slips 45 can be provided at either or both of the opposed ends of the barrel.

In the embodiment of FIG. 7, a plurality of bows have the opposed ends 71, 72 thereof attached to the exterior of barrel 46. The bows provide a drag device and are well known to those skilled in the art. Barrel 46 has a plurality of windows 73 formed therein for receiving radially active slips 45 therein. The outer face of the slips 45, 45' are provided with the illustrated casing engaging teeth that arrest uphole and downhole movement of the anchor device when extended into engagement with the interior of the casing.

The slip assembly 44 has upper and lower wedge faces 74 and 75 that are formed on the inner working surface thereof in opposition to the illustrated casing engaging teeth. Cones or wedges 65, 65' are provided with wedge engaging faces 76, 77 made complementary to wedge faces 74, 75, to force the slips 45 radially outward when the wedges 65, 65' are moved axially towards one another. The lower end 78 of wedge 65' abuts the upper face of bearing 70 while the lower face of the bearing 70 abuts the upper face of annular shear flange 66. The bearing 70 is slidably received on the mandrel 35. The J-pin 58 is attached to the barrel and is shown positioned within J-slot 52 at a location above groove 50 and thereby is positioned to lock the mandrel and barrel together to prevent relative axial rotation therebetween. This is the locked position of operation. This locked position allows slips 45 of the slip assembly 44, and wedges 65, 65' to be positioned in a neutral or retracted position so that the anchor can be run downhole without becoming engaged with the casing sidewall. The J-pin 58 is moved into groove 50 when the anchor slips are set and the mandrel rotated respective to the barrel and casing.

In the embodiment of the invention of FIG. 6, the rotatable mandrel 35 of the downhole tubing anchor 34 is provided with a groove 150 that includes a C-slot 152 formed at a medial position thereof. The C-slot 152 on the mandrel receives the J-pin 58 therein for restraining axial movement between the mandrel and the barrel, thereby retaining the slips retracted when running into and out of the hole in the before described manner of FIG. 3. Opposed wedges 64, 165, confront one another and are moved axially into engagement with respect to the spaced slip assemblies 44 and 44' for extending the slips 45, 45' thereof outwardly and retracting the slips 45, 45' inwardly respective to the barrel windows 73. Lower slip actuator 170 has the upper conical wedge 165 formed thereon for engaging the complementary wedge faces of each slip 45', and further includes a circumferentially extending keeper at boss 49, 49' that bears against the slip assembly and retains the individual slips 45 thereof biased towards the central axis of the barrel and in the retracted position.

Bearings 97 of FIG. 6 are sandwiched between the upper race 98 and lower race 98', with lower race 98' abutting against face 100 of shear flange 166 and upper face of race 98 thereof abutting against the shoulder that forms the annular pocket 102 located within the lower slip actuator. The lower slip actuator, together with annular shear flange 166, forms a bearing chamber within which the bearing components elements 97, 98, 98'' are received. Shear bolts 68 affix annular shear flange 166 to the mandrel and rotate therewith. Shearing bolts 68 releases the slips 45 from the wedge 165 to retract the slips 45 radially inwardly from the casing wall and thereby allow retrieval of the entire tubing string along with the downhole pump P.

In FIG. 6, C-slot 152 has an upper and lower curved portion 154 that communicates with the entrance 153 thereinto. Those skilled in the art can now readily appreciate that mandrel 35, when the J-pin 58 is in the wide groove between shoulders 160 and 162, can be rotated so long as the J-pin is above or below the C-slot 152. The J-pin 58 can be aligned with the entrance 153 of the C-slot 152, whereupon J-pin 58 can be rotatably guided into the C-slot until the pin bottoms out at either end 154 thereof, whereupon picking up the mandrel results in the J-pin being firmly seated within the part 154. In this position, the locking action of the J-latch device has rendered the mandrel substantially immovable respective to the barrel, and the mandrel cannot be manipulated for setting the unset slips 45 of the anchor device until the J-pin 58 is manipulated by the mandrel out of the C-slot and into the operative position between the spaced shoulders 160 and 162 of FIG. 6.

As particularly seen in FIG. 3, J-slot 52 has a lower curved portion that communicates with entrance 53. Those skilled in the art can now readily appreciate that mandrel 35, when the J-pin is in the wide groove 50, can be rotated to align the J-pin 58 with entrance 53 of the J-slot 52, whereupon the J-pin 58 can move and be guided along the slot until the pin bottoms out at the lower end 54' of part 54, whereupon picking up the mandrel results in the J-pin being seated within the blind end part 54'. In this position, the locking action of the J-latch device has rendered the mandrel substantially immovable respective to the barrel, and the mandrel cannot be manipulated for setting the unset slips 45 of the anchor device until the J-pin 58 is manipulated by the mandrel into the operative position seen in FIG. 3.

In FIG. 7 the rotatable mandrel of the downhole tubing anchor is provided with a very wide groove 150 that extends from shoulder 160 to shoulder 162 and accomodates a C-slot 152 within which J-pin 58 is received for running into and out of the hole in the before described manner of FIG. 6. Opposed wedges 76, 77 confront one another and move axially into engagement with slip assembly 44 for extending slips 45 thereof outwardly and retracting slips 45 inwardly of the window 73. Lower slip actuator 82 has the lower wedge 77 formed thereon for engaging complementary wedge face 75 of each slip 45, and further includes a circumferentially extending boss 84 that bears against the upper race of bearing 70 to force the slip actuator 82 uphole when the mandrel 35 is urged uphole to thereby place the lower end of tubing 26 in tension. The lower race of bearing 70 bears against the shear flange 66 at 88. Shear bolts 68 engage the mandrel and force bearings 70 against boss 84 to set the slips and thereby place tubing 26 in tension.

Shoulder 86, located on the lower part 42 of the tubing string, is spaced from the annular shear flange 66 to provide ample lost motion when it is desired to shear the pins 68 and thereby maintain the dissembled parts accumulated near the bottom of the anchor device. Shearing the pins 68 releases the slips 45 from the wedge 77 to retract the slip 45 axially inwardly from the casing wall and thereby retrieve the entire tubing string along with the downhole pump P.

In operation, the tubing anchor device 34, 134 or 234 is interposed within the tubing string any desired distance above pump P, the locking device at 52, 58 is placed in the locked position, and the apparatus is run downhole into the borehole on the tubing string to a predetermined depth, thereby properly spacing out the pump and associated apparatus. At this time, the J-pin 58 is in the end 54 of the J-slot 52 so that the upper end of the tubing string can subsequently be manipulated to extend and set slip assembly 44 of the anchor device 34 into engagement with the casing wall.

Then the wellhead 16, along with the tubing rotator 22 and other illustrated members, are all assembled in the manner of FIG. 1. Next, the tubing string is set down, causing mandrel 35 to urge the J-pin into part 55 of the J-slot; whereupon the tubing is then picked up, using a weight indicator, to assure that J-pin 58 travels along parts 55, 56, 53, and into the circumferentially extending wide groove 50.

The groove 50 will at first appear to be excessively wide until it is realized that there must be ample lost motion between the co-acting parts to assure that the confronting shoulders at 88 and 90 of the bearing assembly 70 of FIG. 7, for example, carries the tension load of the tubing string rather than the J-pin 58 abutting the lower circumferential shoulder 160 of the groove 150. Hence, it is desirable that J-pin 58 comes to rest more or less equally spaced between the shoulders 60 and 62 of the groove 50 in the illustrated manner of FIGS. 3 and 7, for example, whereby J-pin 58 is free to rotate within groove 50 under normal production conditions during rotation of the tubing string.

The rotator 22 is connected in the manner of FIG. 1 so that oscillation of the rocking beam of a pumpjack unit moves the actuator pull line 28 each upstroke of the polish rod and thereby pulls the line which oscillates ratchet arm 30 which in turn successively rotates shaft 32 to thereby rotate the drive mechanism therefor and to rotate the hanger mandrel 33 which in turn rotates tubing string 26 all the way from upper swivel means 24 down to the lower end of the pump.

It is possible to successfully use this invention in a crooked vertical hole with the anchor set at 7,000 ft, for example, the tail pipe extending 6300 ft therebelow, and the seating nipple located at 12,290 ft for a total depth of 13,300 ft.

In a borehole having a crooked upper marginal length of 5,000 ft, for example, from the bottom of which there extends a horizontal marginal length of 1200 ft, for example, it is possible to successfully use this invention with the anchor being set at the bottom of the vertical 5,000 foot part of the borehole and the tail pipe extending therebelow and into the horizontal 1200 foot marginal length thereof, whereby the anchor rotates the tail pipe located in the horizontal section of the borehole.

I claim:

1. In a wellbore having a rod string actuated downhole pump for producing fluid up a tubing string to the surface of the ground, a wellhead at the top of the wellbore, an anchor device by which the lower end of the tubing string is anchored to the lower end of the wellbore to place the tubing string in tension; the method of reducing wear between the rod string and the interior wall of the tubing string; comprising the steps of:

connecting the upper end of the tubing string to a tubing rotator means;

rotatably mounting a mandrel within a downhole anchor device and connecting the lower end of the tubing string to said mandrel of said anchor device; and, using said anchor device for placing a lower force on the downhole end of the tubing string to thereby place the tubing string in tension.

2. The method of claim 1 and further including the steps of:

locking the anchor mandrel respective to the anchor device and manipulating the tubing string to retract said anchor device from attached relationship respective to the wellbore wall;

unlocking the anchor mandrel respective to the anchor device and rotating the tubing string from the surface while conveying fluid through the rotating tubing string.

3. The method of claim 2 wherein the wellbore is cased, and further including the steps of fixing and releasing the anchor device downhole in the borehole by means of slips that are moved radially outward into engagement with the interior surface of the casing when the anchor mandrel is lifted uphole by the tubing string.

4. The method of claim 1 wherein the rod string actuated pump is reciprocated by a pumpjack unit, and further including the steps of rotatably mounting a hanger to the tubing rotating means and rotating the hanger in response to reciprocation of the pumpjack unit, supporting said hanger from the wellhead; and suspending the tubing string from said hanger.

5. The method of claim 1 wherein the borehole is cased and the anchor has an outer barrel, and further including the steps of mounting radially active slips for movement respective to the barrel, and selectively locking said mandrel to said outer barrel in response to manipulation of the tubing string to set and to release the slips of the anchor device respective to the inner wall of the casing.

6. The method of claim 1 and further including the steps of reciprocating the rod string to actuate the downhole pump; providing a swivel joint above the tubing rotator means through which fluid produced by the downhole pump flows;

using the tubing rotator means to rotate a hanger; connecting the upper end of the tubing string to the hanger while connecting the lower end of the tubing string to the anchor mandrel and thereby place the rotating tubing string in tension; forming a passageway that extends through said swivel, hanger, tubing string, and through the anchor mandrel through which the reciprocating sucker rod extends.

7. In a production unit for a cased wellbore having a wellhead and a rod string connected to actuate a downhole pump for producing fluid up through a tubing string to the surface of the ground, the tubing string having an upper end and a lower end, the combination with said production unit of apparatus for rotating the tubing string respective to the rod string while holding the tubing string in tension;

said apparatus includes an upper mandrel attached to the upper end of the tubing string, a tubing rotator by which said mandrel is rotatably supported from the wellhead; a downhole tubing anchor device connected to the lower end of the tubing string by which a lower end of the tubing string is held in tension at a location downhole in the borehole while concurrently rotatably anchored to the casing string;

said downhole tubing anchor device has a hollow lower mandrel that is connected to form a continuation of the tubing string; said anchor device includes a barrel, extensible slip means mounted on said barrel for radial movement respective to the barrel and mandrel; said barrel is concentrically arranged about said mandrel and the mandrel in mounted for axial movement therewithin, bearing means by which said mandrel rotatably engages said barrel and thereby transfer loads from the string into the slips and then into the casing wall; means responsive to axial movement of the mandrel respective to the barrel for extending said slips into engagement with a casing wall and thereby releasably attach the lower end of the tubing string to the well casing whereby the rotating tubing string can be placed in tension between said upper tubing rotator and said anchor device.

8. The combination of claim 7 wherein there is means forming a J-slot in said mandrel and means forming a circumferentially extending groove about said mandrel, said J-slot has an end communicating with the groove about said mandrel; and a J-pin fixed to the barrel and extending inwardly into registry with the mandrel groove and J-slot; means moving said slips radially outward into engagement with the interior surface of a casing in response to upward movement of the mandrel into registry with the groove, whereupon the J-pin rides in the rotating groove of the mandrel as the mandrel is rotated by the tubing string.

9. The combination of claim 8 wherein said tubing rotator includes a hanger mandrel rotatably received therewithin for supporting and rotating the upper end of the tensioned tubing string, means connecting the hanger mandrel and tubing rotator to rotate the hanger mandrel, and means by which the upper end of the tubing string is removably attached to the hanger mandrel.

10. The combination of claim 7 wherein said mandrel has an enlargement that forms a shoulder, and bearing means abuttingly received against said mandrel shoulder for supporting said mandrel from the casing interior to hold the tubing string in tension and to set the slips.

11. The improvement of claim 7 wherein locking means are connected to selectively lock said mandrel to said barrel in response to manipulation of the mandrel by the tubing string; means by which said tubing string, when the mandrel is locked to the barrel, can be actuated to set and release the slips of the anchor device respective to the casing wall.

12. In a cased wellbore having a rod actuated downhole pump that produces fluid up a tubing string to the surface of the ground, a wellhead attached to the top of the casing, an anchor device by which the lower end of the tubing string is anchored to the casing to place the tubing string in tension; the improvement comprising;

tubing rotating and supporting means including a hollow hanger mandrel rotatably supporting the upper end of the tubing string from the wellhead, said hanger mandrel places an upward force on said tubing string while the tubing string is rotated by the tubing rotating and supporting means; swivel means connected to receive flow from the upper end of the hanger mandrel through which fluid produced by the downhole pump is discharged;

said anchor device has an anchor hollow mandrel; said anchor hollow mandrel has an upper end connected to be rotated by the lower end of the tubing string, said anchor hollow mandrel places a downward force on the lower end of the rotating tubing string to thereby place the tubing string in tension, said anchor hollow mandrel has a lower end connected to receive flow of fluid produced by the downhole pump which flows uphole toward the hanger mandrel;

said anchor device is positioned downhole in the borehole and includes a barrel circumferentially extending about the anchor hollow mandrel; journal means rotatably mounting the anchor hollow mandrel respective to the barrel, and radially active slip means attached to the barrel by which the barrel of the anchor device is releasably fixed to the interior of the casing; and means extending said slip means into engagement with the interior wall of the casing to fix the barrel respective to the casing.

13. The improvement of claim 12 wherein locking means is connected to selectively lock said mandrel to said barrel in response to manipulation of the tubing string; means by which said tubing string, when the mandrel is locked to the barrel, can be actuated to set and release the slips of the anchor device respective to the casing wall.

14. The improvement of claim 13 wherein said locking means includes a J-slot in said mandrel, a J-pin affixed to said barrel, a circumferentially extending groove at the bottom of the J-slot; said J-pin enters the J-slot to lock the mandrel to the barrel, said J-pin enters the groove of the mandrel to unlock the mandrel respective to the barrel; the slip means of said anchor device is extended into attached relationship respective to the casing and is retracted in response to said mandrel being manipulated by the tubing string.

15. The improvement of claim 13 wherein said rod is reciprocated by a pumpjack unit, said tubing rotating and supporting means includes a tubing rotator which is affixed to the wellhead and includes means therein that engages the hanger mandrel and rotates the hanger mandrel while the tubing rotator is rotated in response to reciprocation of the pumpjack unit.

16. The improvement of claim 13 wherein said tubing rotator and support means further includes a housing;

the upper end of the hanger mandrel is rotatably supported in journeled relationship within said housing and is connected to place the upper end of the tubing string in tension while means at the upper end of the hanger mandrel engages and rotates the hanger mandrel;

whereby, the hanger mandrel places the upper end of the tubing string in tension while the anchor device places the lower end of the tubing string in tension with there being a passageway that extends through said swivel, hanger mandrel, tubing string, and anchor mandrel of the anchor device and through which the rod reciprocating extends into engagement with the downhole pump.

17. In a cased wellbore that is produced by a rod actuated downhole pump to lift fluid up through a tubing string to a wellhead at the surface of the ground, the improvement comprising:

said tubing string has an upper end opposed to a lower end, a tubing rotator supported by said wellhead and connected to rotate said upper end of said tubing string; a fluid conducting swivel means above said upper end of said tubing string through which produced fluid from the downhole pump can flow;

a tubing anchor supported at said lower end of said tubing string by which said tubing string is placed in tension; said tubing anchor includes a barrel, a mandrel, bearing means by which said mandrel is rotatably affixed to said barrel;

said tubing anchor includes radially active slips supported for extension and retraction respective to said barrel; and means connected to extend said slips in response to axial movement of said mandrel respective to said barrel;

whereby, the tubing string can be placed in tension between the rotator and the anchor mandrel and the tubing string rotated respective to the casing to thereby reduce the contact area between said tubing and rod string.

18. The improvement of claim 17 wherein there is further included means forming a J-slot in said mandrel and means forming a circumferentially extending groove about said mandrel, said J-slot has an end thereof communicating with the groove about said mandrel; and a J-pin fixed to the barrel and extending inwardly into registry with the mandrel groove and J-slot;

means moving said slips radially outward into engagement with the interior surface of a casing in response to upward movement of the mandrel into registry with the groove, whereupon the J-pin rides in the rotating groove of the mandrel as the mandrel is rotated by the tubing string.

* * * * *

UNITED STATES PATENT AND TRADEMARK OFFICE

CERTIFICATE OF CORRECTION

PATENT NO. : 5,327,975

DATED : JULY 12, 1994

INVENTOR(S) : JOHN LARRY LAND and RODGER DALE LACY

It is certified that error appears in the above-identified patent and that said Letters Patent is hereby corrected as shown below:

On title page, ITEM [75] SHOULD READ:

Inventor: JOHN L. LAND, HOBBS, N. MEX.; RODGER DALE LACY, LOUISVILLE, COLORADO.

Signed and Sealed this

Seventeenth Day of September, 1996

Bruce Lehman

*Attest:*

BRUCE LEHMAN

*Attesting Officer*

*Commissioner of Patents and Trademarks*